US008082705B2

(12) United States Patent
Jaster et al.

(10) Patent No.: US 8,082,705 B2
(45) **Date of Patent: *Dec. 27, 2011**

(54) SKYLIGHT TUBE WITH REFLECTIVE STRUCTURED SURFACE

(75) Inventors: Paul Jaster, Carlsbad, CA (US); David W Rillie, San Diego, CA (US)

(73) Assignee: Solatube International, Inc., Vista, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/049,555

(22) Filed: Mar. 16, 2011

(65) Prior Publication Data

US 2011/0162304 A1 Jul. 7, 2011

Related U.S. Application Data

(63) Continuation of application No. 11/438,178, filed on May 22, 2006.

(51) Int. Cl.
*E04B 7/18* (2006.01)

(52) U.S. Cl. ..... 52/200

(58) Field of Classification Search ..... 52/200; 359/591

See application file for complete search history.

(56) References Cited

U.S. PATENT DOCUMENTS

| | | | | |
|---|---|---|---|---|
| 3,383,675 | A * | 5/1968 | Carrothers et al. | 340/321 |
| 4,339,900 | A * | 7/1982 | Freeman | 52/200 |
| 4,505,143 | A * | 3/1985 | Knudson | 72/187 |
| 5,246,782 | A * | 9/1993 | Kennedy et al. | 428/421 |
| 5,506,924 | A * | 4/1996 | Inoue | 385/129 |
| 5,546,712 | A * | 8/1996 | Bixby | 52/200 |
| 5,896,712 | A * | 4/1999 | Chao | 52/200 |
| 5,896,713 | A * | 4/1999 | Chao et al. | 52/200 |
| 5,983,581 | A * | 11/1999 | DeBlock et al. | 52/200 |
| 7,146,768 | B2 * | 12/2006 | Rillie | 52/200 |
| 7,322,156 | B1 * | 1/2008 | Rillie et al. | 52/200 |
| 2002/0126362 | A1 * | 9/2002 | Shimomura | 359/196 |
| 2003/0061775 | A1 * | 4/2003 | Rillie | 52/200 |
| 2005/0166490 | A1 * | 8/2005 | Darmer et al. | 52/200 |
| 2006/0191214 | A1 * | 8/2006 | Rillie | 52/200 |
| 2007/0074468 | A1 * | 4/2007 | Jaster et al. | 52/200 |

OTHER PUBLICATIONS

"Corrugation." Dictionary.com Unabridged. Random House, Inc. Jun. 3, 2011. <Dictionary.com http://dictionary.reference.com/browse/corrugation>.*

* cited by examiner

*Primary Examiner* — Basil Katcheves
*Assistant Examiner* — Branon Painter
(74) *Attorney, Agent, or Firm* — John L. Rogitz

(57) ABSTRACT

A skylight shaft substrate is rendered internally reflected in several ways. To limit the formation of focal points that can lead to hot spots as light travels down the shaft, the shaft substrate is formed with dimples or longitudinal corrugations.

4 Claims, 3 Drawing Sheets

SKYLIGHT TUBE WITH REFLECTIVE STRUCTURED SURFACE

This is a continuation of and claims priority to U.S. patent application Ser. No. 11/438,178, filed May 22, 2006.

FIELD OF THE INVENTION

The present invention relates generally to skylights.

BACKGROUND OF THE INVENTION

In U.S. Pat. Nos. 5,896,713 and 6,035,593, both of which are owned by the same assignee as is the present invention and both of which are incorporated herein by reference, tubular skylights are disclosed. Both of the skylights can use the skylight dome disclosed in U.S. Pat. No. 5,896,712 also owned by the same assignee as is the present invention and also incorporated herein by reference. These inventions represent advances over the prior art and one or more of them has found commercial success.

Briefly, a tubular skylight such as those mentioned above includes a tube assembly mounted between the roof and ceiling of a building. The top end of the tube assembly is covered by a roof-mounted dome or cover, such as the one disclosed in the above-mentioned '712 patent, while the bottom end of the tube assembly is covered by a ceiling-mounted diffuser plate. With this combination, natural light external to the building is directed through the tube assembly into the interior of the building to illuminate the interior.

Tubular skylights use a near specular finish reflective surface to transport sunlight down the tube from the roof to the interior ceiling. "Specular" means that reflected direct rays of sunlight maintain a near parallel beam of light as they reflect down the tube if the tube sides are parallel and the specular reflective surface is maintained.

The present invention understands that sunlight enters the tube at various incident angles based on time of day/year, latitude, and tube opening plane location. Despite the fixed position of the tube, direct beam sunlight reflects down the perimeter of the tube at approximately the same elevation angle as it enters the tube. As understood herein, this can result in the following undesirable outcomes. First, the parallel beam sunlight can converge at concentrated focal points at various locations down the tube, resulting in potentially dangerous hot spots that can cause fires particularly in the presence of combustible materials. Second, uneven illumination results at the base diffuser of the tube, because the perimeter path of the light rays in combination with the focal points can cause partial and non-uniform illumination of the diffuser. The result is poor illumination performance and glare from the diffuser. Additionally, the direct light beams passing through a prism in the diffuser can cause the separation of the wavelengths and project rainbows into the interior.

Accordingly, the present invention makes the following critical observations. Direct beam sunlight reflected from a specular surface in the approximate shape of a tube can create hot spots that are unsafe and that reduce product performance due to non-uniform illumination. As further understood herein, simply reducing the specularity of the tube results in reduced light transmission. Likewise, installing a diffuser above the tube to address glare and hot spots reduces the total system performance due to the transmission loss of this extra diffuser and the increased tube reflections caused by the light spread. Moreover, attempting to remedy the above-noted shortcomings using a random patterned reflector results in the light being diffused in a hemispherical shape that may send greater than 50% of the light back up the tube, therefore once again reducing performance. With the above observations in mind, the invention herein is provided.

SUMMARY OF THE INVENTION

The interior of a skylight tube is formed with structures that change sunlight beam angles to prevent the formation of a focal point, and/or that mix the light to uniformly illuminate the base diffuser and eliminate glare and color separation, and/or that control light direction to prevent retro-reflection and excessive reflections.

Accordingly, in a first aspect a skylight assembly has a transparent dome and a skylight shaft substrate extending away from the dome to convey light entering the dome through the shaft substrate. Surface irregularities are formed on the shaft substrate. The surface irregularities can be dimples or longitudinal corrugations.

In some implementations the shaft substrate is metal and is polished to provide a reflective surface without any reflective film incorporated into the assembly. In other implementations the shaft substrate is metal and a reflective metal is deposited as by vapor deposition directly on the inside surface of the shaft substrate to render the assembly internally reflective without incorporating an adhesive into the assembly. In yet other implementations the shaft substrate may be a reflective film with a metallic substance being vapor-deposited onto the film or with a reflective multi-layer polymer composite being adhered to the substrate.

When the surface irregularities are longitudinal corrugations, each corrugation defines a midline and opposed edges, and a first angle is formed between transverse tangents to edges of first corrugations. Also, a second angle different from the first angle is formed between transverse tangents to edges of second corrugations. The first and second corrugations alternate around the circumference of the shaft substrate, and may be V-shaped or U-shaped in transverse cross-section.

When the surface irregularities are plural dimples, each dimple defines a center and a periphery. A tangent to the periphery establishes an angle with respect to a tangent to the center of no more than two degrees.

In another aspect, a skylight assembly includes a transparent dome and a skylight shaft substrate extending away from the dome to convey light entering the dome through the shaft substrate. Surface irregularities are formed on the shaft substrate. In this aspect, the shaft substrate is metal, and a reflective metal is deposited directly on the inside surface of the shaft substrate to render the assembly internally reflective without incorporating an adhesive into the assembly.

In yet another aspect, a skylight assembly includes a transparent dome and a skylight shaft substrate extending away from the dome to convey light entering the dome through the shaft substrate. Surface irregularities are formed on the shaft substrate. In this aspect, the shaft substrate is metal and is polished to provide a reflective surface without any reflective film incorporated into the assembly.

In still another aspect, a skylight assembly includes a transparent dome and a skylight shaft substrate extending away from the dome to convey light entering the dome through the shaft substrate. Surface irregularities are formed on the shaft substrate. In this aspect, the shaft substrate is a reflective film with a metallic substance being vapor-deposited onto the film.

In another aspect, a skylight assembly includes a transparent dome and a skylight shaft substrate extending away from the dome to convey light entering the dome through the shaft substrate. Surface irregularities are formed on the shaft substrate. In this aspect, the shaft substrate is a reflective film including a reflective multi-layer polymer composite.

The details of the present invention, both as to its structure and operation, can best be understood in reference to the accompanying drawings, in which like reference numerals refer to like parts, and in which:

DETAILED DESCRIPTION OF THE PREFERRED EMBODIMENT

Figure 1:
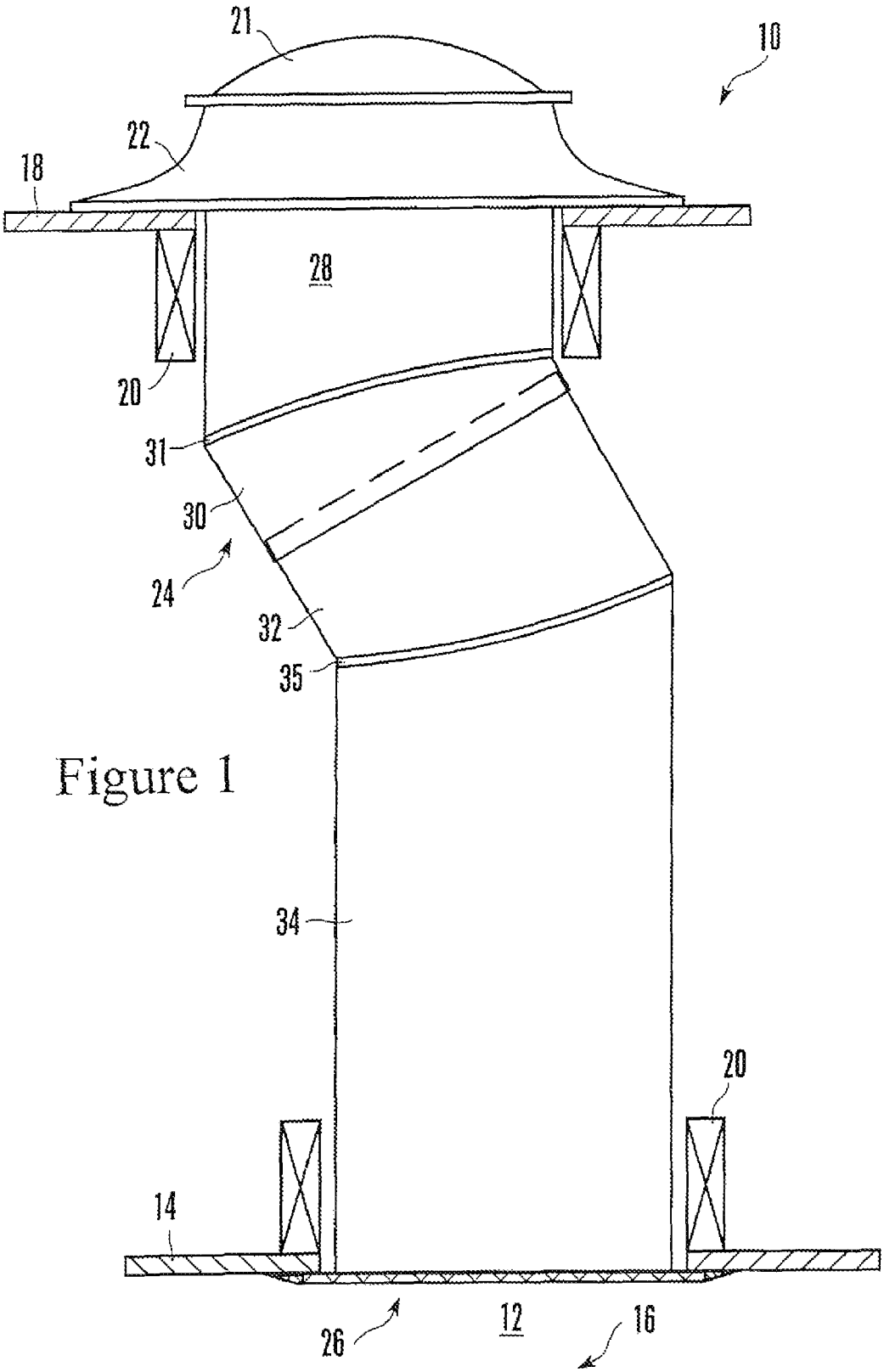
FIG. 1 is a side view in partial cross-section of the tubular skylight of the present invention.
Figure 2:
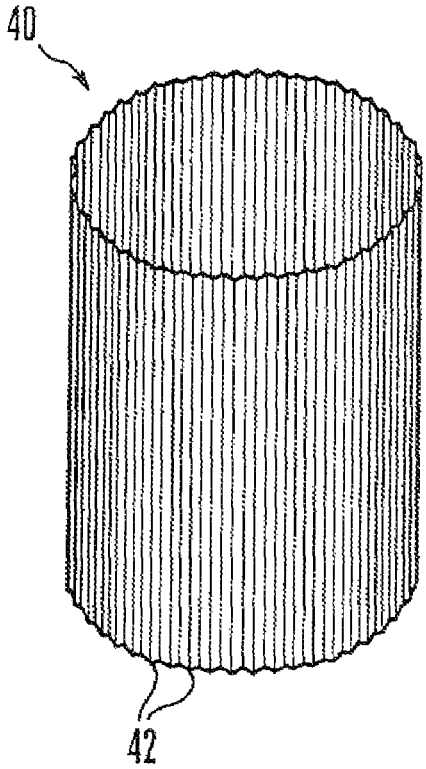
FIG. 2 is a perspective view of the present tube with longitudinal corrugations for reducing focal points.
Figure 3:
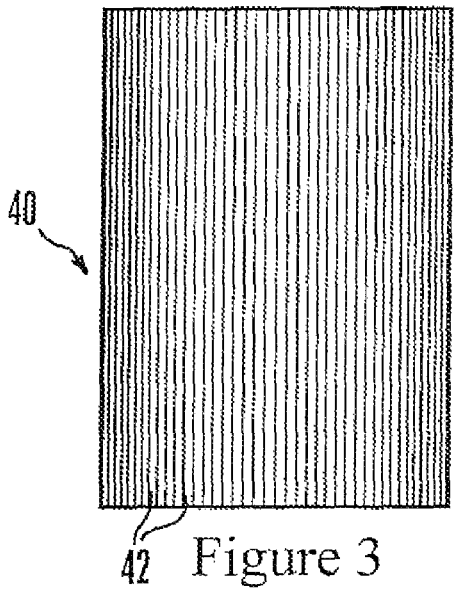
FIG. 3 is a side elevational view of the inside of the tube shown in FIG. 2.
Figure 4:
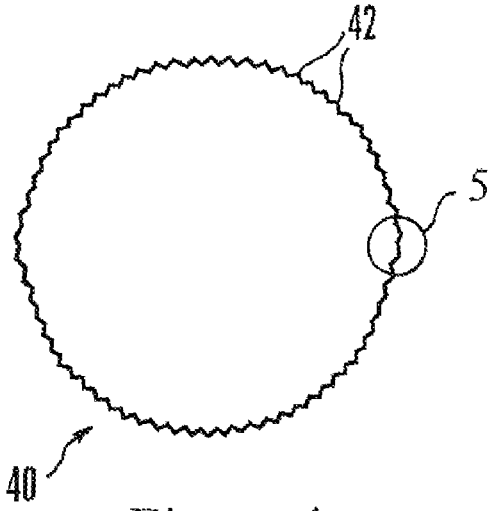
FIG. 4 is a top plan view of the tube shown in FIG. 2.

Referring initially to FIG. 1, a tubular skylight made in accordance with the present invention is shown, generally designated 10, for lighting, with natural sunlight, an interior room 12 having a ceiling dry wall 14 in a building, generally designated 16. FIG. 1 shows that the building 16 has a roof 18 and one or more joists 20 that support the roof 18 and ceiling dry wall 14.

As shown in FIG. 1, the skylight 10 includes a rigid hard plastic or glass roof-mounted cover 21. The cover 21 is optically transmissive and preferably is transparent. In one embodiment, the cover 21 can be the cover disclosed in the above-mentioned '712 patent. Or, the cover 21 can be other suitable covers, such as the covers marketed under the trade name "Solatube" by the present assignee.

The cover 21 can be mounted to the roof 18 by means of a ring-like metal flashing 22 that is attached to the roof 18 by means well-known in the art. The metal flashing 22 can be angled as appropriate for the cant of the roof 18 to engage and hold the cover 21 in the generally vertically upright orientation shown.

As further shown in FIG. 1, an internally reflective hollow shaft assembly, generally designated 24, is connected to the flashing 22. The cross-section of the assembly 24 can be cylindrical, rectangular, triangular, etc. Accordingly, while the word "tube" may be used from time to time herein, it is to be understood that the principles of the present invention are not to be limited to a cylinder per se unless otherwise specified.

The shaft assembly 24 extends to the ceiling 14 of the interior room 12. Per the present invention, the shaft assembly 24 directs light that enters the shaft assembly 24 downwardly to a light diffuser assembly, generally designated 26, that is disposed in the room 12 and that is mounted to the ceiling 14 or to a joist 20 as described in the above-mentioned '593 patent.

The shaft assembly 24 can be made of a metal such as an alloy of aluminum or steel, or the shaft assembly 24 can be made of plastic or other appropriate material. The interior of the shaft assembly 24 may be rendered reflective by means of, e.g., electroplating, anodizing, metalized plastic film coating, or other suitable means. In one preferred embodiment, the shaft assembly 24 is rendered internally reflective by laminating the inside surface of the shaft assembly with a multi-ply polymeric film made by Minnesota Mining and Manufacturing (3M). A single ply of such film is transparent, but when hundreds of layers are positioned flush together and then thermally laminated to the interior surface of the shaft assembly 24, the combination is specularly reflective.

Thus, in non-limiting implementations the shaft may be made of a composite of a metal substrate, e.g., aluminum or steel, with a reflective film adhered to the shaft using an adhesive. The shaft substrate can also be made of a polymer with the reflective film bonded to it.

Alternatively, if the shaft is metal, the shaft substrate can be polished to provide a reflective surface or have a highly reflective metal such as silver or aluminum vapor deposited directly to its surface without the need for a separate adhesive.

In yet other implementations a reflective film itself may be used as a shaft substrate. In such an implementation, metal is vapor-deposited onto the film surface. Or, the film can include a reflective multi-layer polymer composite.

In one preferred embodiment, the shaft assembly 24 is established by a single tube. However, as shown in FIG. 1, if desired, the shaft assembly 24 can include multiple segments, each one of which is internally reflective in accordance with present principles. Specifically, the shaft assembly 24 can include an upper shaft 28 that is engaged with the flashing 22 and that is covered by the cover 21. Also, the shaft assembly 24 can include an upper intermediate shaft 30 that is contiguous to the upper shaft 28 and that can be angled relative thereto at an elbow 31 if desired. Moreover, the shaft assembly 24 can include a lower intermediate shaft 32 that, if desired, may be slidably engaged with the upper intermediate shaft 30 for absorbing thermal stresses in the shaft assembly 24. And, a lower shaft 34 can be contiguous to the lower intermediate shaft 32 and join the lower intermediate shaft 32 at an elbow 35, with the bottom of the lower shaft 34 being covered by the diffuser assembly 26. The elbow 35 may be angled as appropriate for the building 16 such that the shaft assembly 24 connects the roof-mounted cover 21 to the ceiling-mounted diffuser assembly 26. It is to be understood that where appropriate, certain joints between shafts can be mechanically fastened and covered with tape in accordance with principles known in the art.

In any case, the present shaft assembly 24 is formed with surface irregularities on part or all of its inner surface for reflecting light in a way that minimizes the chance of hot spots while nonetheless maximizing light throughput. The surface irregularities may be those described in the present assignee's U.S. patent publication no. 2003/0061775, incorporated herein by reference, or the corrugations or dimples disclosed herein.

More specifically, FIGS. 2-5 show a hollow shaft 40 that may be used as any one of the shafts or shaft segments shown in FIG. 1 and that is formed throughout its length and circumference with linear longitudinal corrugations 42, it being understood that the corrugations 42 may be formed in only part of the length and/or circumference of the shaft 40. As shown best in FIG. 5, the corrugations 42 can have a V-shape in transverse cross-section, although alternately they may be U-shaped.

In general, each corrugation can vary in its included angle from less than one hundred eighty degrees to greater than one degree, and preferably the included angle is greater than one hundred twenty degrees to minimize reflections. Also, the angle can vary around the shaft to provide a greater amount of mixing of the light before it reaches the base diffuser, as will be made clearer momentarily in reference to FIG. 5.

In addition to the controlled light spreading features, the corrugations 42 also allow easier bending of the substrate, when metal, to form a cylindrical shaft from a sheet, and to increase the lateral strength of the shaft 40 due to the increased moment of inertia this geometry provides. These two features allow easier assembly of small diameter tubing and the use of reduced caliper metal due to the increased strength.

Figure 5:
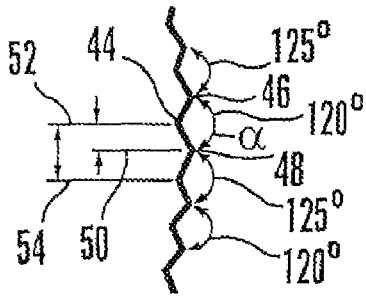
FIG. 5 is a detail of part of the circumference of the tube in circle "5" of FIG. 4.
Figure 6:
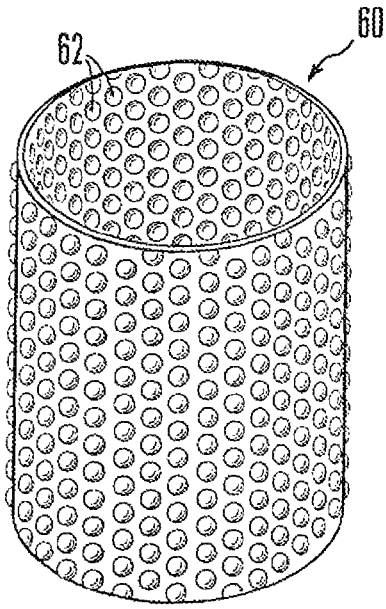
FIG. 6 is a perspective view of an alternate tube with dimples for reducing focal points.
Figure 7:
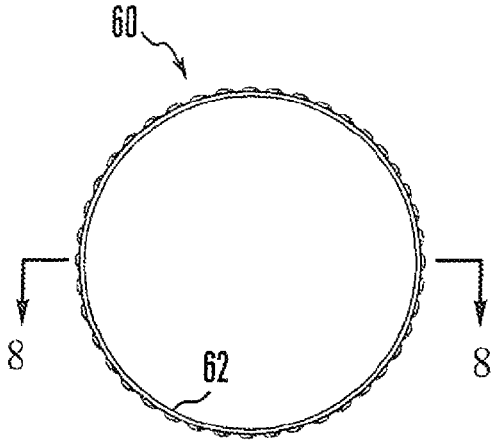
FIG. 7 is a top plan view of the tube shown in FIG. 6.
Figure 8:
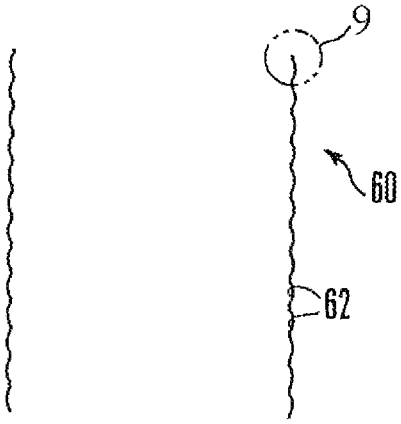
FIG. 8 is a side elevational view of the tube as seen along the line 8-8 in FIG. 7.
Figure 9:
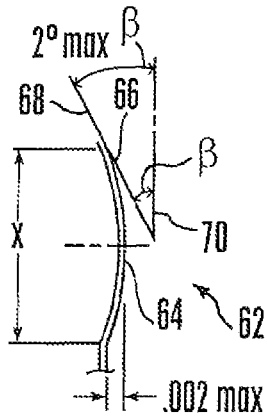
FIG. 9 is a detail of a dimple in circle "9" of FIG. 8.

With greater attention to preferred non-limiting details in FIG. 5, each corrugation 42 defines a midline 44 and opposed edges 46, 48, with adjacent edges of adjacent corrugations joining each other as shown. While for illustration the midlines 44 in FIG. 5 are defined to be the parts of the corrugations that are radially inset from the edges, hence establishing concave corrugations, the skilled artisan will readily appreciate that the convention can be reversed, i.e., that midlines can be defined to be the radially outside parts of the corrugations, hence establishing convex corrugations.

In any case, FIG. 5 shows that an angle $\alpha$ is formed between transverse tangents to the edges 46, 48 of each corrugation. When the corrugation is V-shaped as shown, the transverse tangents are simply lines extending in the transverse dimension from the midline 44 to each edge 46, 48 as shown, i.e., the angle $\alpha$ is the angle of the "V". As further shown in FIG. 5, odd-numbered corrugations can have a first angle $\alpha$, e.g., one hundred twenty degrees, whereas even-numbered corrugations can form a second angle $\alpha$, e.g., one hundred twenty five degrees, with the odd-numbered corrugations alternating around the circumference of the shaft 40 with the even-numbered corrugations. This geometry results as shown in an angle of two and a half degrees being established between the normal 50 to an edge 48 and the normal 52 to the adjacent midline 44, and an angle of five degrees being established between the normal 52 to a midline 44 and the normal 54 to the next successive midline 44.

Alternatively to corrugations, FIGS. 6-9 show a dimpled hollow shaft 60 that may be used as any one of the shafts or shaft segments shown in FIG. 1. Specifically, the shaft 60 is formed throughout its length and circumference with dimples 62, it being understood that the dimples 62 may be formed in only part of the length and/or circumference of the shaft 60.

A dimple 62 may have any suitable shape, e.g., one of the myriad of shapes of golf ball dimples, e.g., spherical, elliptical, parabolic, hyperbolic, etc. In the illustrative non-limiting embodiment shown best in FIG. 9, each dimple 62 has a concave (or convex, depending on the perspective, i.e., outside or inside) saucer-like shape and hence can establish what might be thought of as the very bottom portion of spherical or parabolic or other bowl that is curvilinear throughout its surface.

Accordingly, in the non-limiting implementation shown, each dimple 62 defines a center 64 and a preferably circular periphery 66. A tangent 68 to the periphery 66 establishes an angle $\beta$ with respect to a tangent 70 to the center 64 of no more than two degrees (to give greater resolution for seeing the angle $\beta$ in FIG. 5, the tangent 70 to the center 64 has been offset to the right of the center 62.) Additionally, the distance in the radial dimension between the center 64 and periphery 66 preferably is less than one half inch (<0.5 inches, or less than approximately one and one-quarter centimeters). By limiting the angle $\beta$ to less than two degrees, the loss of low elevation sunlight is prevented. By limiting the distance in the radial dimension between the center 64 and periphery 66 to less than one-half inch, excessive reflections are prevented, which could otherwise eventually lead to sunlight being reflected back up and out of the dome 21 (FIG. 1) and hence decrease the light throughput of the shaft 60.

In non-limiting embodiments the corrugations and/or dimples described above can be formed in any appropriate way. In one non-limiting example the metal shaft, or the reflective film, or the adhesive can be formed or patterned with an embossing roller. In another example the metal shaft, film, or adhesive can be extruded or coated with the required profile in the extrusion or coating die. Yet again, the metal shaft, film, or adhesive can be molded with the required pattern in a mold tool.

While the particular SKYLIGHT TUBE WITH REFLECTIVE STRUCTURED SURFACE is herein shown and described in detail, the invention is to be limited by nothing except the appended claims.

What is claimed is:

1. A skylight assembly, comprising:

a transparent cover; and at least one skylight shaft substrate extending away from the cover to convey light from the dome through the shaft substrate;

plural surface irregularities being formed on the shaft substrate, the irregularities being established by elongated corrugations, each corrugation defining an elongated midline straddled by elongated edges and having a transverse cross-section describing an angle, a first angle on an inside surface of the substrate being formed by the transverse cross-sections of first corrugations, a second angle on the inside surface of the substrate being formed by the transverse cross-sections of second corrugations, the first angle being different than the second angle.

2. The assembly of claim 1, wherein first corrugations alternate with second corrugations around the circumference of the shaft substrate.

3. The assembly of claim 1, wherein the corrugations are V-shaped in transverse cross-section.

4. The assembly of claim 1, wherein the corrugations are U-shaped in transverse cross-section.

* * * * *